United States Patent [19]

Frystak et al.

[11] Patent Number: 4,960,273

[45] Date of Patent: Oct. 2, 1990

[54] DUAL MODE DOCUMENT FEEDER

[75] Inventors: Richard Frystak, Park Ridge; John S. O'Callaghan, Sr., Wilmette, both of Ill.; Jean-Jacques Colson, Incourt, Belgium

[73] Assignee: Bell & Howell Company, Skokie, Ill.

[21] Appl. No.: 344,710

[22] Filed: Apr. 28, 1989

[51] Int. Cl.[5] ..... B65H 5/00

[52] U.S. Cl. ..... 271/10; 271/34; 271/117; 271/122

[58] Field of Search ..... 271/9, 10, 34, 117, 271/121, 122, 124, 125, 126, 127, 147, 157, 160, 162

[56] References Cited

U.S. PATENT DOCUMENTS 3,957,366 5/1976 Taylor et al. ..... 271/34 X

FOREIGN PATENT DOCUMENTS 1181238 11/1964 Fed. Rep. of Germany ..... 271/122

2011477 1/1980 Fed. Rep. of Germany ..... 271/122

*Primary Examiner*—Joseph J. Rolla

*Assistant Examiner*—David H. Bollinger

*Attorney, Agent, or Firm*—Neuman, Williams, Anderson & Olson

[57] ABSTRACT

A document feeder includes a feed tray which is pivotal about a horizontal axis between an elevated automatic position in which it can be locked and in which the uppermost document of a stack of documents thereon is engaged with an endless belt skimmer to be fed from the stack, and a lowered manual position away from the skimmer for manual feed of a single document. A reverse feed roller is movable with the feed tray and is operative in the automatic position to inhibit feed of documents other than the uppermost document of a stack.

18 Claims, 4 Drawing Sheets

DUAL MODE DOCUMENT FEEDER

BACKGROUND OF THE INVENTION

1. Field of the Invention

This invention relates to a dual mode document feeder and more particularly to a feeder for automatic and manual feeding of documents to microfilming and/or other document processing apparatus. The feeder of the invention is easy to use and facilitates rapid and efficient feeding of documents, while being highly reliable and trouble-free in operation, and it is relatively simple in construction, readily adjustable to obtain optimum results and is economically manufacturable.

2. Background of the Prior Art

Prior art types of microfilming and other copying or document processing apparatus oftentimes incorporate automatic feed mechanisms which are designed for feeding documents one-by-one from a stack of documents but which allow manual insertion of a single document on top of a stack which is positioned for automatic feed to allow it to be advanced by the automatic mechanism in place the top document of the stack. This and other similar types of manual feed operations are sometimes difficult to achieve and oftentimes leads to feeding of two or more documents at once and paper jams, the feeding mechanism being primarily designed for automatic feed operations.

Another type of feeder of the prior art requires removal or installation of a feeder mechanism when changing between manual and automatic feed operations. In some feeders, separate manual and automatic document feeder mechanisms may be provided, one being completely removed from the machine and the other being installed when the operator wishes to change between a manual mode and an automatic feed mode. Typically, the automatic feed mechanisms of such feeders may receive power either mechanically from a gear drive inside the copying machine or from a drive mechanism inside the document feeder itself. When the automatic feeder is not in use, the feeder is removed and stored off of the copying machine. This type of feeder has been generally satisfactory when proper care is exercised and has been used extensively. However, it is expensive, not easy to use and is not without reliability and maintenance problems.

SUMMARY OF THE INVENTION

This invention was evolved with the general object of providing document feeders which are easier to use than those of the prior art while being more reliable and trouble-free in operation and while also being manufacturable at reasonable cost.

Important aspects of the invention relate to the discovery and recognition of problems with prior art feeders and the causes of such problems as well as in an analysis of the operation of prior art devices to overcome problems therewith while retaining those features which are desirable.

A variety of problems with prior art automatic feeders arise in connection with attaching the automatic feeders to a processing machine for operation and then removing the automatic feeders in order to use the machine in the manual mode. It is found that major problems occur in the engagement and disengagement of feeders to the copying machine. To engage a feeder mechanism of a type which relies upon power from the main copying machine, alignment of the powering mechanism to the automatic feeder is found to be critical. Usually, the aligning of the feeder with the drive mechanism has required at least a few attempts before the feeding mechanism becomes properly mated with the copier. Not only did this feature try the patience of the operator, but it has also created considerable wear and tear on the engagement mechanism as the feeder is jockeyed into position.

It has also been found that disengagement of the feeder mechanism presented other problems, as well. To ensure that the drive mechanism of the copying machine properly activates an automatic feeder, the mechanical fit between the two mechanisms has to be precise. While a precise fit may be provided to obtain a reliable feed mechanism, it is found that this same precise fit can cause problems when the automatic feeder is removed. Removal requires a certain amount of manipulation on the part of the operator. This, too, has added increased wear and tear on both systems. It has also been discovered that over a period of time, the changing of trays created alignment and noise problems.

Previous automatic feeder mechanisms of a type which have their own motor do not encounter the same mechanical problems as those devices receiving power from the main machine. However, one of their major drawbacks is the same as one of the drawbacks of the copier driven feeder mechanisms. Both require the operator to either attach or remove the feeder mechanism from the copying machine. Since this type of automatic feeder contained its own drive motor, the problems of engagement and disengagement from the copier did not present the same mechanical problems. But, since this type of automatic feeder is self-powered, a source of power must be provided. Consequently, this feeder mechanism not only requires attachment to the copier but necessitates the second step of locating a power source and making a connecting thereto.

As can be seen, existing automatic feed mechanisms require a certain amount of labor when changing from automatic feed to manual feed and vice-versa. In modern office systems where time is at a premium, complex systems in use today only add to already existing time pressures. This invention is therefore directed to avoiding down time due to equipment malfunction and lost time due to feeder changes and to provide improved feed systems which avoid breakdowns and prevent lost time resulting from continual feeder system substitutions.

In accordance with important features of the invention, a dual mode feeder is provided which includes a non-removable skimmer assembly for automatic feed of documents, preferably including both a skimming roller and an endless belt. In addition, a document support is provided which includes a control surface which may be defined by a feed tray, the control surface and the skimmer being supported by the apparatus for movement relative to each other between automatic and manual conditions. In the automatic condition, the control surface engages the underside of a stack of documents to place the documents in a position such that the skimmer frictionally engages the upper side of an uppermost document of the stack, to feed the document forwardly to microfilming or other document processing means. In the manual condition, the control surface engages the underside of a single document away from the skimmer and in a position for direct manual feed to the processing means.

With this comparatively simple arrangement, conversion between automatic and manual feed operations is accomplished without removal or installation of any feeding mechanism. The arrangement permits highly reliable automatic feeding and also allows manual feeding to be readily accomplished, allowing feeding of thick as well as thin documents without interference from the skimmer mechanism.

Preferably a feed tray which defines the control surface is pivotal about a generally horizontal axis for movement between an elevated position in the automatic condition in which a stack of documents is supported for engagement of the top document by the skimmer and a lowered position in the manual condition in which a document is movable to the document processor through a region below the skimmer.

The document feeder of the invention is also arranged for the inclusion of reverse feed means for operation in the automatic condition to inhibit forward feed of documents of a stack below the topmost document engaged by the skimmer. The reverse feed means is separated from the skimmer in the manual mode.

In accordance with further specific features of the invention, the reverse feed means is carried for movement with the feed tray to be conjointly movable with the control surface, with adjustment means being provided for adjusting the position of the reverse feed means relative to the control surface and thereby relative to the skimmer in the automatic condition. Preferably, the reverse feed means is carried by a support which is rotatable about the pivot axis of the feed tray and which is adjustable relative to the feed tray. In a preferred embodiment, it is formed by a roller which is rotated about a horizontal axis parallel to the pivotal axis of the feed tray, the roller being driven from a drive element which is rotatable about the pivotal axis of the feed tray.

Further important features of the invention include the provision of means to urge the feed tray upwardly to its automatic position; the provision of means to releasably lock the feed tray in each of its automatic and manual positions; the provision of a hand feed shelf for providing an extension of the control surface in its manual position, the hand feed shelf being also usable to control locking of the feed tray in its manual position; the construction of the skimmer with means to urge an endless skimmer belt thereof toward the control surface; and protection against engagement of a skimmer roller with the control surface.

These and other objects, features and advantages will become more fully apparent from the following detailed description taken in conjunction with the accompanying drawings.

It should be understood that the drawings are not necessarily to scale and that an embodiment is sometimes illustrated in part by phantom lines and fragmentary views. In certain instances, details of the actual structure which are not necessary for the understanding of the present invention may have been omitted. It should be understood, of course, that the invention is not necessarily limited to the particular embodiments illustrated herein.

DESCRIPTION OF PREFERRED EMBODIMENTS

Figure 1:
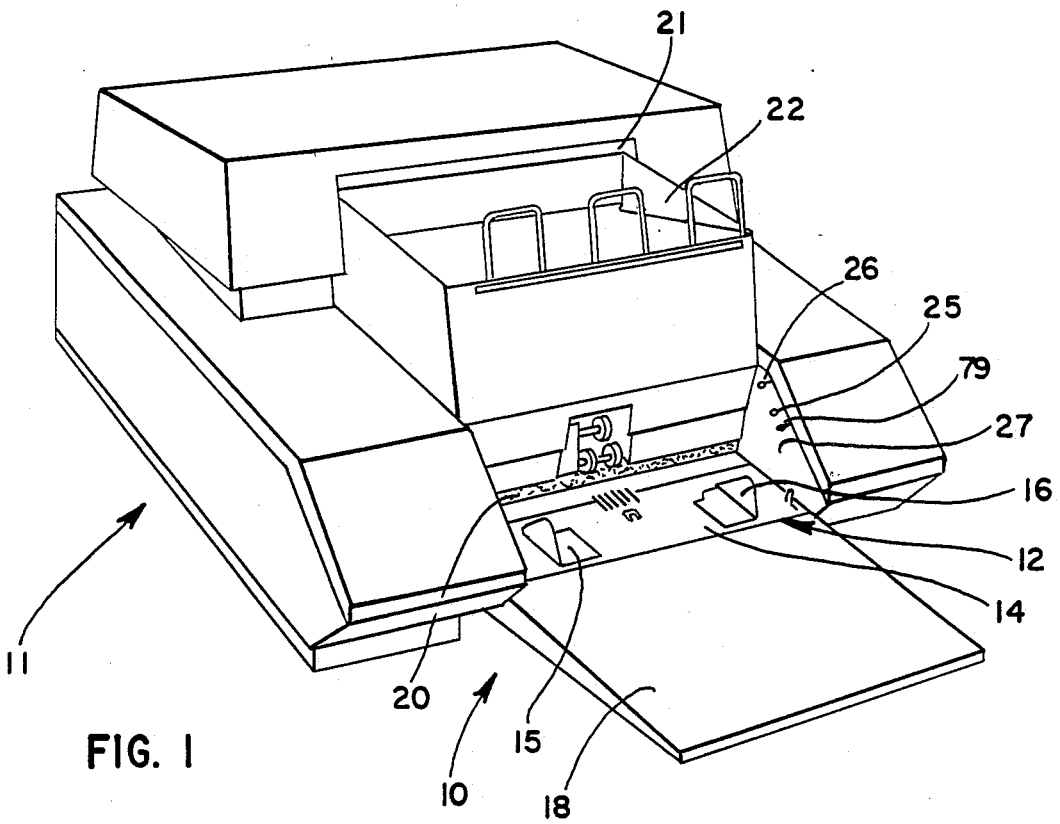
FIG. 1 is a perspective view of microfilming apparatus which includes a dual mode document feeder of the invention, shown in a manual condition of operation.

In FIG. 1, reference numeral 10 generally designates a document feeder of the invention which is shown incorporated in a microfilming system generally designated by reference numeral 11.

The document feeder 10 includes a feed tray 12 which is shown in a manual position in FIG. 1. For manual feed of documents, the operator places a single document on a control surface 14 of the feed tray 12, between a pair of side guides 15 and 16. If the document is longer than the length of the control surface 14, it may extend rearwardly onto the upper surface of a hand feed shelf 18. The operator simply moves the document forwardly into an input opening 20 of the system 11 whereupon the document is drawn into and processed by processing apparatus of the system. A copy of the document is then reproduced on microfilm after which the document is delivered through an out-feed opening 21 to a delivery receptacle 22.

Figure 2:
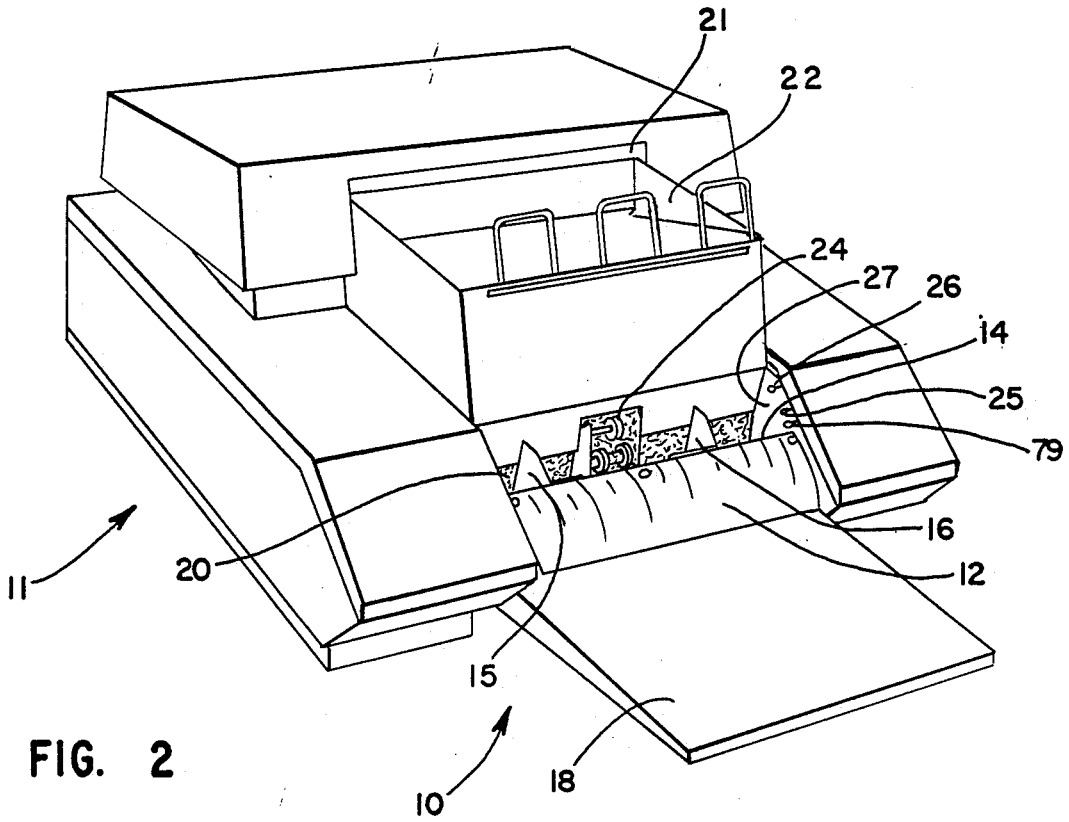
FIG. 2 is a perspective view of the microfilming apparatus which is like FIG. 1 but which shows the dual mode document feeder of the invention in an automatic condition.

For automatic operation, the hand feed shelf 18 is pulled rearwardly, whereupon the feed tray 12 is released and moved by spring means to an automatic position as shown in FIG. 2. In the automatic condition of FIG. 2, a stack of documents may be placed against the control surface 14 of the feed tray 12 between the side guides 15 and 16, whereupon the uppermost document of the stack is engaged by a skimmer unit 24 to be moved into the opening 20 of the system 11.

Thereafter, the documents are moved one-by-one until the lowermost document of the stack has been fed into the system 11. If the stack of documents is longer than the length of the control surface 14, an auxiliary tray may be installed using a pair of pins 25 and 26 which are on a vertical wall 27 on one side of the document feeder 10, and using a corresponding pair of pins on an opposite wall, not visible in the drawings.

The document feeder 10 of the invention is thus very easy to operate and does not require removal and installation of separate units to shift between manual and automatic modes. It is also highly reliable and trouble-free in operation.

Figure 3:
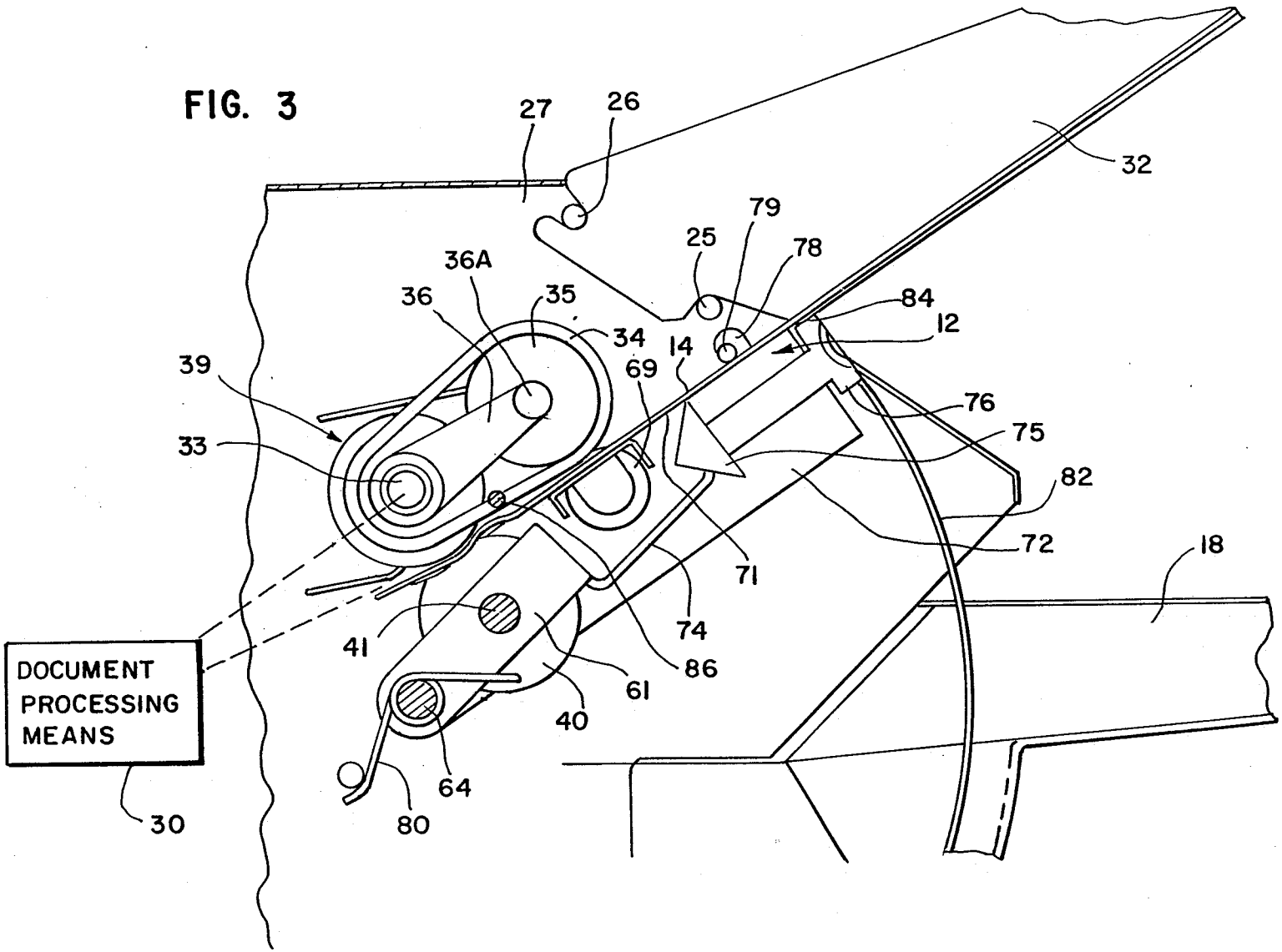
FIG. 3 is a schematic sectional view showing portions of the document feeder in elevation and in the automatic condition, also showing schematically in block form the document processing means of the system.

FIG. 3 is a schematic sectional view showing portions of the document feeder 10 in elevation and in the automatic condition, also showing schematically, as a block 30 the document processing means of the system 11. It will be understood that such document processing means, as such, are not part of the invention. The document processing means 30 includes means for receiving the document which is fed either manually or automatically through the opening 20 and also includes drive apparatus which is mechanically coupled to drive shafts of the document feeder 10, as hereinafter described.

FIG. 3 also shows a portion of an auxiliary feed tray 32 which may be optionally installed on the pins 25 and 26 and those on the other side of the document feeder 10.

Figure 4:
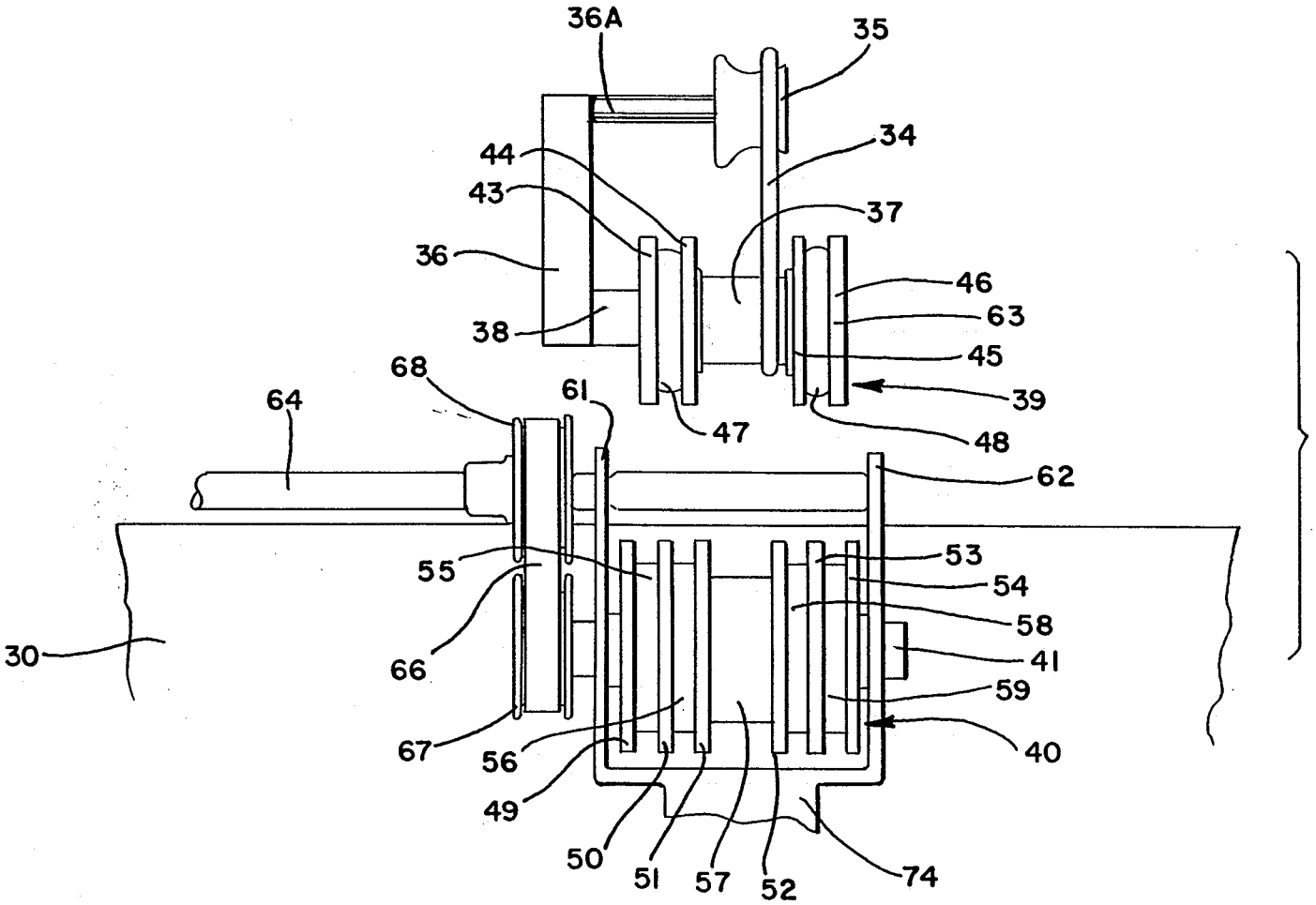
FIG. 4 is a diagrammatic front view showing the relationship and cooperation of a reverse roller assembly and a skimming roller assembly.

To effect an automatic feed operation, the operator drops a stack of documents onto the control surface 14 of the feed tray 12, and onto the auxiliary feed tray 32 if used, the stack of documents being inserted under an endless skimmer belt 34 which is entrained around a support pulley 35 journaled on a shaft portion 36A of a support arm 36 and which is also entrained around a rotating cylindrical drive surface 37 on a shaft 38, the surface 37 being shown in FIG. 4.

The skimmer belt 34 moves the document forwardly and downwardly toward the document processing means while at the same time, the forward lower edges of the documents of the stack are engaged by peripheral feed surfaces provided by a feed roller assembly 39 which is driven from the shaft 38. The lower and forward edges of the documents below the uppermost document are engaged by peripheral surfaces of rollers of a reverse feed assembly 40 which is mounted on a shaft 41.

As viewed in FIG. 3, the skimmer roller assembly 39 is rotated in a clockwise direction while the reverse roller assembly 40 is also rotated in a clockwise direction. The result is that the uppermost document is fed forwardly and downwardly while documents below the uppermost document are restrained against forward/-downward movement by the reverse roller assembly 40.

FIG. 4 illustrates the construction of the skimmer roller assembly 39 and that of the reverse roller assembly 40 and also provides a diagrammatic illustration of the relationship therebetween. As shown, the skimmer roller assembly includes four disks 43–46 which are mounted on the shaft 38 along with two spacer disks, the disks 43 and 44 being on opposite sides of the spacer disk 47 and the disks 45 and 46 being on opposite sides of the spacer disk 48. The reverse roller assembly 40 includes six rollers 49–54 with spacers 55–59, so arranged that the disks 43, 44, 45 and 46 are aligned with spaces between disks 49 and 50, 50 and 51, 52 and 53 and 53 and 54. The reverse roller support shaft 41 is carried by a pair of arms 61 and 62 which are supported for pivotal movement about the axis of a drive shaft 64, the reverse roller support shaft 41 being coupled to the drive shaft 64 through a belt 66 engaged with pulleys 67 and 68 which are respectively mounted on the shafts 41 and 64.

It is noted that the skimmer belt 34 and supporting components are urged in a clockwise direction as viewed in FIG. 3, under the influence of gravitational forces acting thereon. To limit such movement and prevent wear from direct frictional contact between the moving belt 34 and the control surface 14 in the absence of a document to be fed, a roller 69 is journaled by the feed tray 12 and is aligned with the belt 34.

The feed tray 12 includes a plate 71 which has an upper surface forming the control surface 14. Plate 71 extends between two support arms 72, only one of which appears in the drawings, such arms being supported for pivotal movement about the axis of the reverse roller drive shaft 64.

As shown in FIG. 3, an extension member 74 which is coupled to the support arms 61 and 62 for the reverse roller assembly 40 engages a conical member 75 which is adjustably movable in a direction generally parallel to the surface 14 to adjust the angular position of the reverse roller assembly 40 relative to the feed tray 12. The adjustment may be effected through rotation of a threaded member 76 having a coin-receiving slot.

As is also shown in FIG. 3, a pair of latch members 78, only one of which is shown appears in the drawings, is engageable with a pin 79 on the wall 27 to lock the feed tray 12 in the automatic position of FIG. 3. Member 78 is pivotal to release the feed tray and to allow the feed tray to be moved downwardly to the manual position, such action being effected against the action of a spring 80 which urges the arm 72 in a counter-clockwise direction, as viewed in FIG. 3.

The feed tray 12 also includes the plate 82 which, in the automatic condition of FIG. 3, extends in an arcuate path about the axis of the shaft 64 from a rearward edge portion of the plate 71 to a position along the forward edge of the hand feed shelf 18, operating to prevent forward movement of any documents which may be placed on the hand feed shelf. In the automatic condition, the hand feed shelf may be used for temporary storage of documents to be processed.

Figure 5:
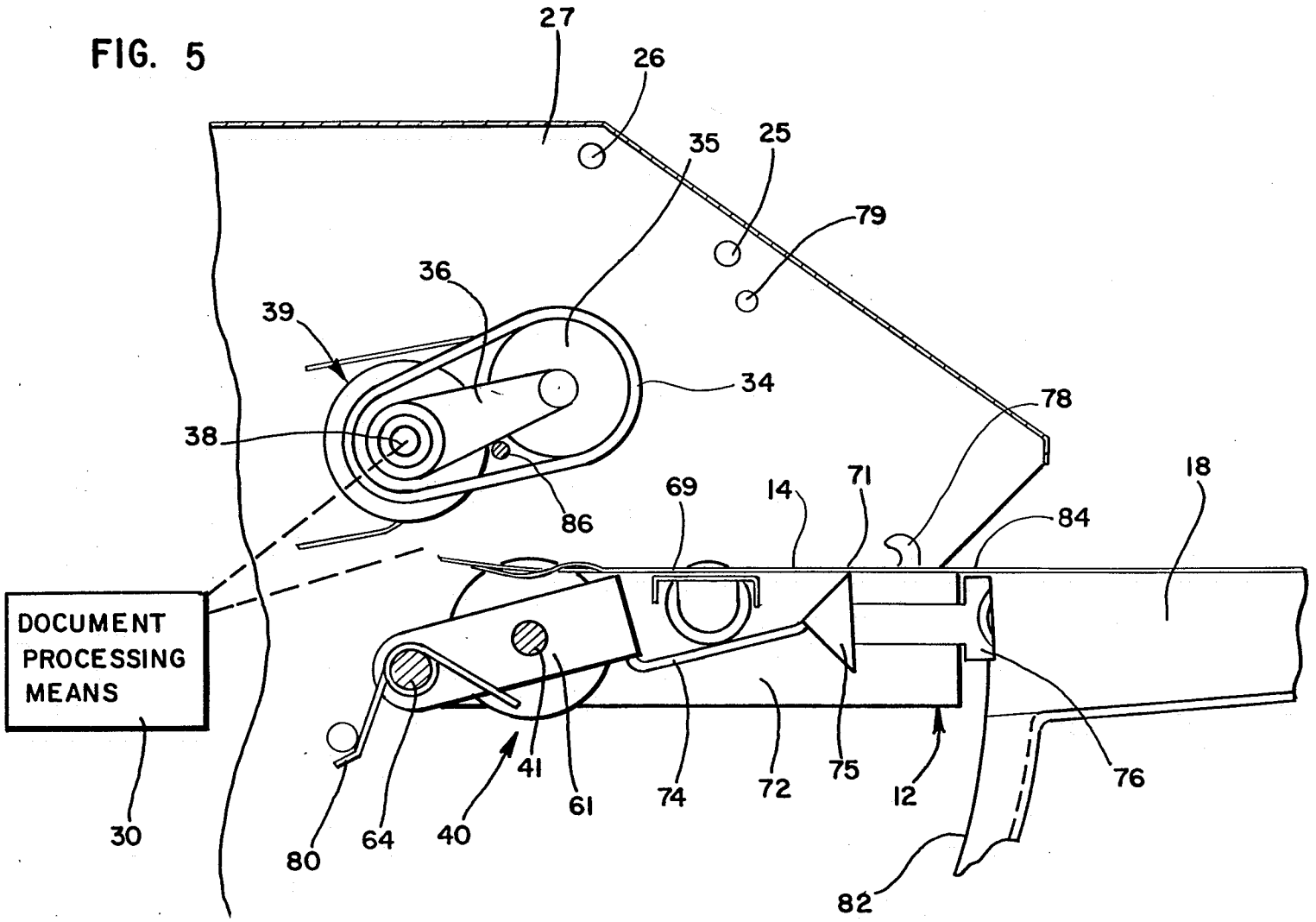
FIG. 5 is a schematic sectional side view similar to FIG. 3, but showing the components of the feeder in a manual condition.

FIG. 5 is a view similar to FIG. 3, illustrating the components in the manual condition. In the position of FIG. 5, a forward edge portion of the hand feed shelf 18 extends over a rearward portion 84 of the plate 71 to prevent upward movement of the feed tray 12 under the influence of the spring 80. The portion 84, as shown, is downwardly offset so as to underlie the forward edge portion of the hand feed shelf 18 and so as to provide a substantially continuous planar surface defined by the control surface 14 and the upper surface of the hand feed shelf 18.

In the manual condition, a pin 86 is engaged by the arm 36 to limit rotation of the skimmer assembly under the force of gravity and to prevent contact of the skimmer belt 34 with the control surface.

FIG. 5 also shows the reverse feed rollers in a position of adjustment different from that shown in FIG. 3, resulting from the positioning of the conical member 75 at a different position. An accurate adjustment of the position of the reverse feed roller is highly desirable and it is important, in this respect, that the feed tray be locked in its upper automatic position shown in FIG. 3. With the invention, the position can be accurately adjusted and since the assembly is permanently included in the system, any adjustment once made can be reliably retained.

It will be understood that modifications and variations may be effected without departing from the spirit and scope of the novel concepts of this invention.

We claim:

1. Document processing apparatus arranged for selective operation in automatic and manual document feed modes and including document processing means and document receiving and feeding means, said document receiving and feeding means comprising: an assembly including skimming means and document support means arranged for selective operation between an automatic condition and a manual condition, said document support means including control surface means for engagement in said automatic condition with the underside of the lowermost document of a stack of documents to position the uppermost document for engagement of the upper surface thereof by said skimming means to feed said uppermost document in a forward feeding direction to said document processing means, and said control surface in said manual condition being arranged to support a single document for direct manual feeding thereof in said forward feeding direction to said document processing means, and said document supporting means comprising a feed tray which defines said control surface means, said feed tray being supported for pivotal movement about a horizontal pivot axis and being shiftable about said pivot axis between an elevated position in said automatic condition and a lowered position in said manual condition.

2. Document processing apparatus as defined in claim 1, wherein said document receiving and feeding means includes reverse feed means for frictionally engaging documents to prevent forward feed of documents other than an uppermost document being fed by said skimming means, said reverse feed means being positioned in proximity to said skimming means for operative cooperation therewith in said automatic condition of said assembly and being substantially completely separated from said skimming means in said manual condition of said assembly.

3. Document processing apparatus as defined in claim 2, wherein said reverse feed means comprises roller means having peripheral surface means for engagement in said automatic condition with the forward edges of documents of a stack of documents engaged by said control surface means, and means for driving said roller means in a direction to urge said documents in a direction opposite forward feed direction and permit forward feed of only the uppermost document by said skimmer means.

4. Document processing apparatus as defined in claim 1, wherein said skimming means comprises endless belt means so supported and arranged as to be urged toward said control surface means for frictional engagement with an upper surface portion of an uppermost document of a stack of documents.

5. Document processing apparatus as defined in claim 4, wherein said skimming means further includes a skimmer roller having a peripheral surface for engagement with said upper surface portion of an uppermost document of a stack of documents, said skimmer roller and said belt being coupled for conjoint operation.

6. Document processing apparatus arranged for selective operation in automatic and manual document feed modes and including document processing means and document receiving and feeding means, said document receiving and feeding means comprising: an assembly including skimming means and document support means arranged for selective operation between an automatic condition and a manual condition, said document support means including a control surface for engagement in said automatic condition with the underside of the lowermost document of a stack of documents to position the uppermost document for engagement of the upper surface thereof by said skimming means to feed said uppermost document in a forward feeding direction to said document processing means, and said control surface in said manual condition being arranged to support a single document for direct manual feeding thereof in said forward feeding direction to said document processing means, wherein said skimming means comprises endless belt means so supported and arranged as to be urged toward said control surface for frictional engagement with an upper surface portion of an uppermost document of a stack of documents, said apparatus further including stop means for limiting movement of said endless belt means toward said control surface means in said manual condition to prevent direct contact therewith.

7. Document processing apparatus arranged for selective operation in automatic and manual document feed modes and including document processing means and document receiving and feeding means, said document receiving and feeding means comprising: an assembly including skimming means and document support means arranged for selective operation between an automatic condition and a manual condition, said document support means including control surface means for engagement in said automatic condition with the underside of the lowermost document of a stack of documents to position the uppermost document for engagement of the upper surface thereof by said skimming means to feed said uppermost document in a forward feeding direction to said document processing means, and said control surface means in said manual condition being arranged to support a single document for direct manual feeding thereof in said forward feeding direction to said document processing means, wherein said control surface means is shiftable between an elevated position in said automatic condition and a lowered position in said manual condition.

8. Document processing apparatus as defined in claim 7, wherein said document support means includes manual support shelf means defining a manual extension surface which forms an extension of said control surface means in said manual condition of said assembly.

9. Document processing apparatus as defined in claim 8, including spring means for urging said control surface means upwardly toward said elevated position, and locking means controlled by said manual support shelf means to hold said control surface means in said lowered position for manual operation.

10. Document processing apparatus as defined in claim 8, further including means providing a surface which in said automatic condition extends downwardly from a rearward edge portion of said control surface means and upwardly from a forward edge portion of said manual extension surface.

11. Document processing apparatus as defined in claim 7, further including locking means for locking said support surface means in said elevated position during operation in said automatic mode.

12. Document processing apparatus as defined in claim 17, wherein said document support means includes an automatic support shelf means defining an automatic extension surface which forms an extension of said control surface means in said automatic condition of said assembly.

13. Document processing apparatus as defined in claim 12, said automatic support shelf being arranged for selective installation and removal depending upon the length of documents to be fed.

14. Document processing apparatus arranged for selective operation in automatic and manual document feed modes and including document processing means and document receiving and feeding means, said document receiving and feeding means comprising: an assembly including skimming means and document support means arranged for selective operation between an automatic condition and a manual condition, said document support means including control surface means for engagement in said automatic condition with the underside of the lowermost document of a stack of documents to position the uppermost document for engagement of the upper surface thereof by said skimming means to feed said uppermost document in a forward feeding direction to said document processing means, and said control surface in said manual condition being arranged to support a single document for direct manual feeding thereof in said forward feeding direction to said document processing means, wherein said document receiving and feeding means includes reverse feed means for frictionally engaging documents to prevent forward feed of documents other than an uppermost document being fed by said skimming means, said reverse feed means being positioned in proximity to said skimming means for operative cooperation therewith in said automatic condition of said assembly and being substantially completely separated from said skimming means in said manual condition of said assembly, wherein said control surface means is shiftable between an elevated position in said automatic condition and a lowered position in said manual condition, and wherein said reverse feed means are supported conjointly with said control surface means for movement between said automatic and manual conditions.

15. Document processing apparatus as defined in claim 14, wherein said control surface means and said reverse feed means are supported for pivotal movement about a common generally horizontal pivot axis.

16. Document processing apparatus as defined in claim 15, including a drive element rotatable about said pivot axis and coupled to said reverse feed means.

17. Document processing apparatus as defined in claim 14, including adjustment means for adjusting the position of said reverse feed means relative to said control surface means for adjustment of the relationship of said reverse feed means to said skimming means in said automatic condition.

18. Document processing apparatus as defined in claim 17, wherein said control surface means and said reverse feed means are supported for pivotal movement about a common generally horizontal pivot axis, said adjustment means being operable to adjust the relative angular position of said control surface means and reverse feed means about said pivot axis.

* * * * *